US006758770B2

(12) United States Patent
Chandronnait

(10) Patent No.: US 6,758,770 B2
(45) Date of Patent: Jul. 6, 2004

(54) SAFETY NETS SYSTEM

(75) Inventor: Alan Bruce Chandronnait, Bow, NH (US)

(73) Assignee: Alan Chandronnait, Bow, NH (US)

( * ) Notice: Subject to any disclaimer, the term of this patent is extended or adjusted under 35 U.S.C. 154(b) by 0 days.

(21) Appl. No.: 10/703,735

(22) Filed: Nov. 7, 2003

(65) Prior Publication Data

US 2004/0110579 A1 Jun. 10, 2004

Related U.S. Application Data

(60) Provisional application No. 60/430,910, filed on Dec. 4, 2002.

(51) Int. Cl.[7] ..... A63B 61/00; A63B 69/38

(52) U.S. Cl. ..... 473/494; 473/492

(58) Field of Search ..... 473/460, 490–494

(56) References Cited

U.S. PATENT DOCUMENTS 2,615,715 A * 10/1952 Ballard ..... 473/495
3,918,711 A * 11/1975 Zak ..... 473/462
4,203,413 A * 5/1980 Hodges ..... 124/78
4,643,423 A * 2/1987 Wright ..... 473/456
4,886,268 A * 12/1989 Langslet ..... 473/492
4,919,421 A * 4/1990 Vandeveld ..... 473/494
6,277,039 B1 * 8/2001 Kleinschrodt ..... 473/460

* cited by examiner

*Primary Examiner*—Raleigh W. Chiu

(57) ABSTRACT

A tensioned cable and two small nets system used on a tennis court to keep tennis balls that are hit into the tennis net from rolling out into the playing area. The two nets are approximately as long but not as high as the tennis net and are located parallel and on opposite sides of the tennis net. The smaller nets are connected to the cable that surrounds the net posts and the tennis net through the means of four horizontal posts with each pair of horizontal posts being connected by an adjustable metal strap and each pair of horizontal posts used on one net post. The adjustable metal strap joins each pair of horizontal posts at a width just wide enough to make them fit snugly against the sides of the vertical net posts forming a horizontal crossbar on each net post. An adjustable fastener is located on the same end but opposite side of the horizontal posts as the metal strap. The adjustable fastener is tightened to keep the horizontal posts in place temporarily until the cable is tightened. The cable is tightened by a tensioning device and passes through or over the outside ends of the horizontal posts pressing the inside edges of the horizontal posts to the sides of the net posts thus keeping them solidly in place and forming the crossbars that hold the cable and smaller nets in place.

1 Claim, 4 Drawing Sheets

SAFETY NETS SYSTEM

CROSS REFERENCE TO RELATED APPLICATIONS

This application claims the benefit of Provisional Patent Application Number 60/430,910 filed Dec. 04, 2002 by the present inventor.

FEDERALLY SPONSORED RESEARCH

None

SEQUENCE LISTING OR PROGRAM

None

BACKGROUND OF THE INVENTION

1. Field of Invention

This invention is primarily used on a tennis court to keep tennis balls that have been hit into the tennis net from rolling into the playing area and becoming a safety issue.

2. Description of Prior Art

Tennis is a sport that can be played by two people in singles or four people in doubles. More players can participate on the court in lessons. In some lesson situations as many as ten players or more could be on the court. One of the consistent problems all players face is the tennis ball that has been hit into the net. In singles, doubles or tennis lessons, the ball that is hit into the net usually rolls out of the net and into the playing area causing a safety issue. Play needs to be immediately stopped or interrupted to clear the potential hazard.

One inventor, U.S. Pat. No. 4,886,268 to Eric B. Langslet, 4 Hilton Pl., Montvale, N.J. 07645 (Dec. 12, 1989), suggests using two smaller nets on either side of the main tennis net that are separated by two plastic spacers located in the center area of the net Having two plastic spacers on the court would be hazardous to any player if they should fall on it, step on it, or run into it. The safety of one aspect is nullified by the danger of the center spacers on the other. The spacers would hold the center portion of the smaller nets away from the tennis net but, as the smaller nets got closer to the tennis posts, the ball capturing area would be very small and inefficient.

Due to the rope or cable being wrapped around the net posts with no tension being added, the rope or cable will sag between the center spacers and the net posts thus not capturing the balls with the same consistency as the shots are missed further from the center of the net.

Also, the C-shaped clamping system used to hold the nets to the tennis posts would not fit larger or smaller net posts nor net posts that are square. It would also be a serious problem to use the C-clamp method when there are other parts of the tennis posts themselves that would interfere with it such as the tennis crank and the tennis net cable. Lastly, the C-clamp method would also be very difficult to put up and take down requiring additional tools such as plyers and wrenches.

Another patent, U.S. Pat. No. 4,895,366 to Joseph A. Bartasius (Jan. 23, 1990), has a ball capturing net that replaces the normal tennis net. There are two meshwork nets that are suppose to capture the tennis balls when they hit the meshwork of one and fall through and get captured between the meshwork of the two nets. This system would not be reliable because the tennis ball may not hit the correct opening of the meshwork and rebound back into the court or the ball may not be hit with enough velocity to make it pass through the meshwork. It would also be difficult to remove the tennis balls that do get trapped between the two nets. The meshwork would have to be lifted by hand and the balls would have to be pulled out by hand or with a tennis racquet. Lastly, the time to weave, produce and the expense of a complicated system like this would be quite great and it would be very difficult to remove the proposed tennis net by the inventor and put on a normal tennis net.

U.S. Pat. No. 5,141,226 to Peter A. Cavanagh (Aug. 25, 1992) is a ball recovery system that is placed near the back fence of a tennis court. It is used to recover balls that are hit over the tennis net and need to be recovered at the back of the court. Balls going into the tennis net are not discussed.

U.S. Pat. No. 269,692 to Tsugio Hirabayashi and Michio Nakai (Jul. 12, 1983) is an ornamental design for a tennis practice net. The practice net is used similar to a backboard where the ball is hit against it and it rebounds to the player. Balls going into a tennis net are not discussed.

BACKGROUND OF THE INVENTION—OBJECTS AND ADVANTAGES

The objects and advantages of the safety nets system are:

a) The safety nets run parallel for the whole length of the tennis net thus giving it consistency in capturing the balls that are hit into the center of the net or even eighteen feet off of center or more.

b) The safety nets are suspended by a tensioned cable or rope so there are no dangerous metal or plastic parts located in the playing area for players to fall on, trip on, or become a safety issue.

c) The safety nets system can be installed on round or square net posts of varying diameters or sizes making it universally adaptable to any tennis net post.

d) The tensioning device can be any device that can create tension on the rope or cable in order to keep the safety nets up. Some tensioning devices could be, but not limited to, hand wenches, tennis cranks, ratchets, etc.

e) The safety nets system is self contained so there are no nuts and bolts, etc. to have to take off or put on.

f) The safety nets system is easily installed or taken down in minutes because of the dynamics of the tensioning system. There are no clamps, screws, ties, etc.

g) The height of the safety nets can be adjusted for personal preference or set higher if the court underneath needs to be cleaned.

h) The over all size of the safety nets system is very handy. It can be stored in a small duffel bag and carried easily by one person.

i) Various types of netting can be used from high quality, very expensive netting to less expensive and more cost efficient netting thus making it affordable for everyone.

Further objects and advantages of my invention will become apparent from a consideration of the drawings and ensuing description.

SUMMARY

The safety nets are held up parallel on both sides of the tennis net by a tensioned rope or cable making it a safe and efficient system in keeping tennis balls from rolling into the playing area and becoming a safety issue.

DRAWINGS—FIGURES

DRAWINGS--Reference Numerals

| | | | |
|---|---|---|---|
| 10 | tennis court | 12 | tennis net |
| 14L | left tennis net post | 14R | right tennis net post |
| 16A | horizontal post | 16B | horizontal post |
| 16C | horizontal post | 16D | horizontal post |
| 18 | tensioning device | 20A | safety net |
| 20B | safety net | 22 | safety net cable |
| 24A | starting fastener | 24B | starting fastener |
| 26A | metal strap | 26B | metal strap |
| 28A | starting fastener holes | 28B | starting fastener holes |
| 30A | metal strap holes | 30B | metal strap holes |
| 32A | safety net cable holes | 32B | safety net cable holes |

PREFERRED EMBODIMENT—DESCRIPTION

FIG. 1

Figure 1:
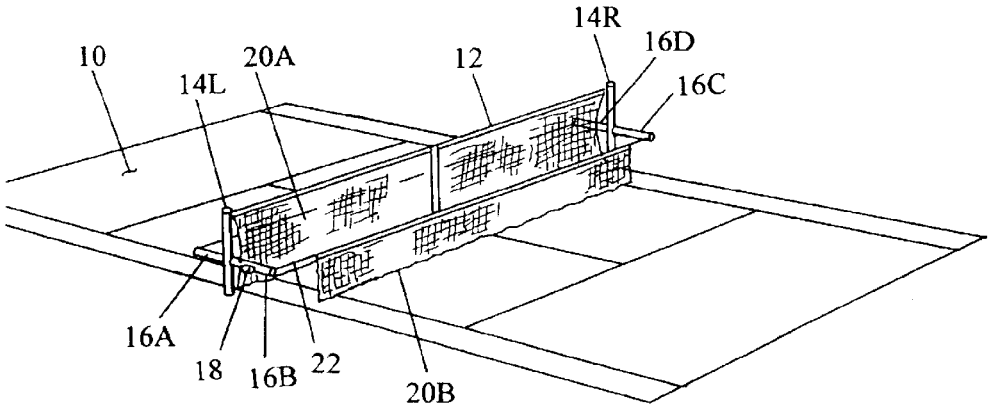
FIG. 1 is a perspective view of a tennis court with the safety nets system.

As shown in FIG. 1, is a perspective view of a tennis court with the safety nets system. A tennis court 10 with a tennis net 12 held up by tennis net posts 14L and 14R. On the sides of the tennis net post 14L are horizontal posts 16A and 16B and on the sides of tennis net post 14R are horizontal posts 16C and 16D that hold up safety nets 20A and 20B by the use of tensioning device 18 on the safety net cable 22.

FIG. 2

Figure 2:
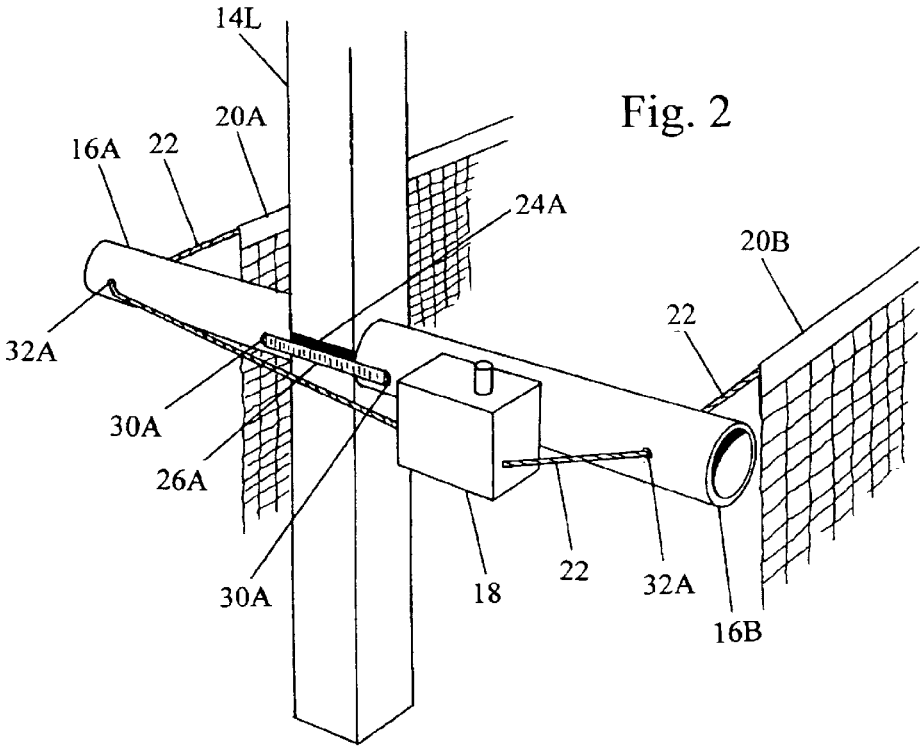
FIG. 2 is a detailed outside view of the left net post.

As shown in FIG. 2, the outside view of tennis net post 14L. Metal strap 26A travels through metal strap holes 30A on the inner end of horizontal posts 16A and 16B. Starting fastener 24A is just visible behind metal strap 26A. Tensioning device 18 is located on horizontal post 16B and tightens safety net cable 22 which travels through safety net cable holes 32A located on the outer ends of horizontal posts 16A and 16B. Safety nets 20A and 20B are held by the tightened safety net cable 22.

FIG. 3

Figure 3:
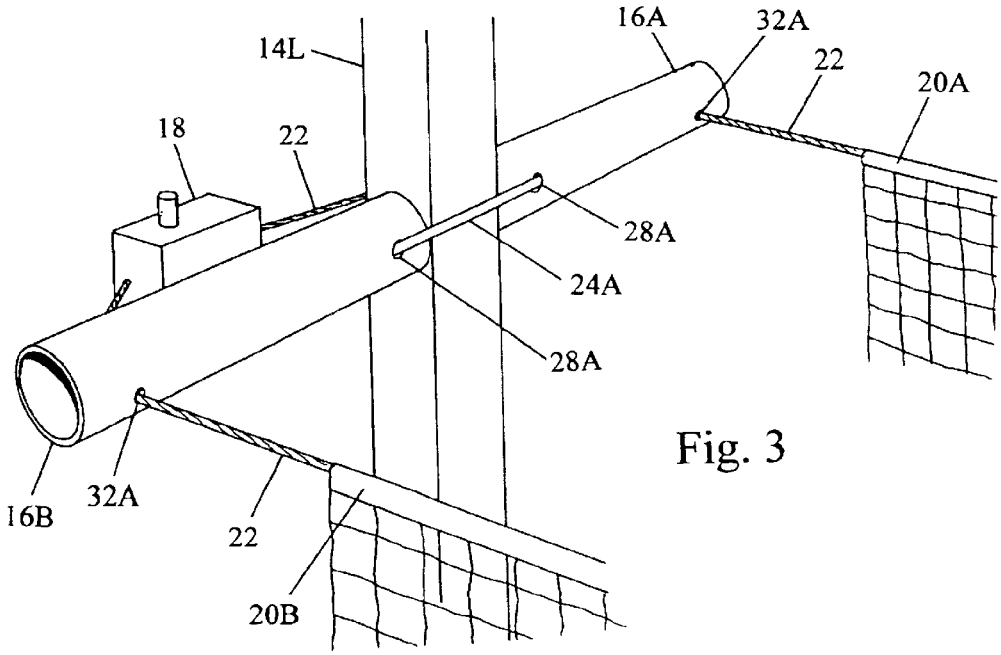
FIG. 3 is a detailed inside view of the left net post.

As shown in FIG. 3, the inside view of tennis net post 14L. Tensioning device 18 tightens safety net cable 22 that goes through safety net cable holes 32A which keeps horizontal posts 16A and 16B pressed against the sides of tennis net post 14L. Starting fastener 24A goes through starting fastener holes 28A and around the tennis net post 14L. Starting fastener 24A allows the horizontal posts 16A and 16B to stay in place until the safety net cable 22 is tightened with tensioning device 18. Because of the tension on safety net cable 22 safety nets 20A and 20B are held up.

FIG. 4

Figure 4:
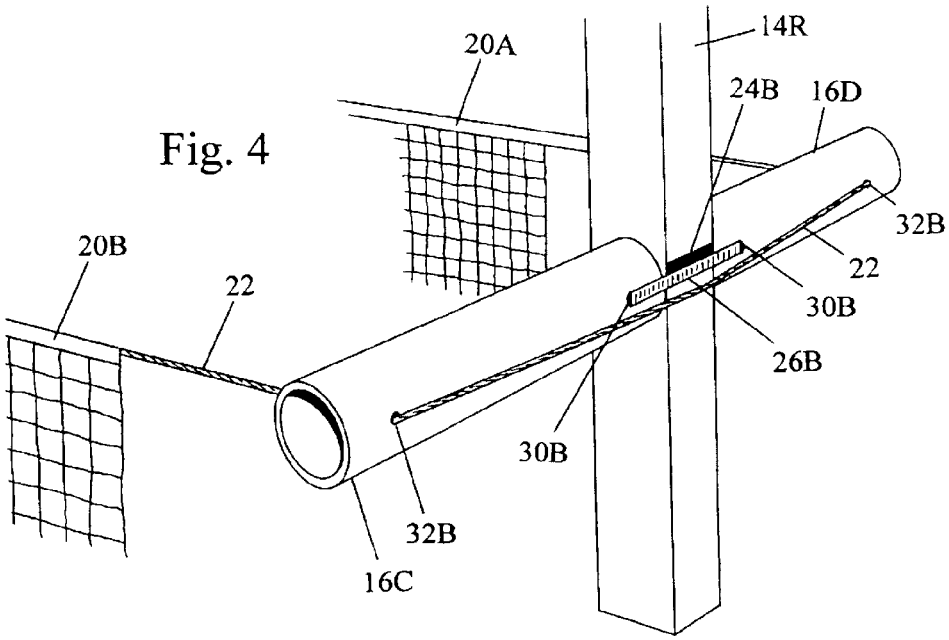
FIG. 4 is a detailed outside view of the right net post.

As shown in FIG. 4, the outside view of tennis net post 14R. Metal strap 26B travels through metal strap holes 30B located on the inner end of horizontal posts 16C and 16D. Starting fastener 24B is just visible behind metal strap 26B. Tightened safety net cable 22 which travels through safety net cable holes 32B on the outer ends of horizontal posts 16C and 16D holds up safety nets 20A and 20B.

FIG. 5

Figure 5:
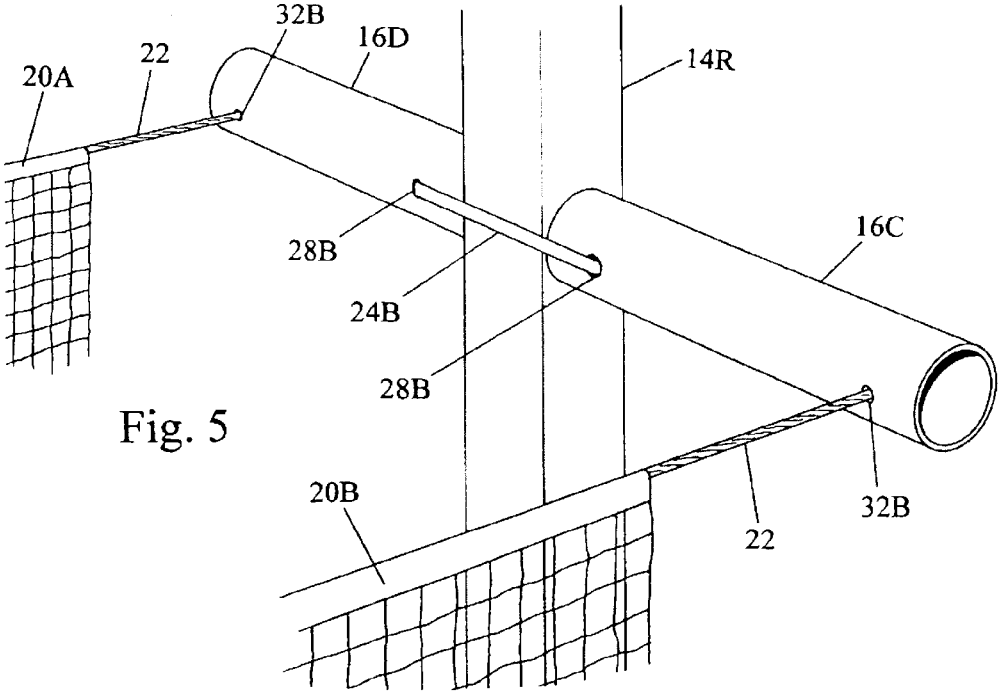
FIG. 5 is a detailed inside view of the right net post.

As shown in FIG. 5, the inside view of the tennis net post 14R Tightened safety net cable 22 that goes through safety net cable holes 32B which keeps horizontal posts 16C and 16D pressed against the sides of the tennis net post 14R. Starting fastener 24B goes through starting strap holes 28B and around tennis net post 14R. Starting strap 24B allows the horizontal posts 16C and 16D to stay in place until safety net cable 22 is tightened. Because of the tension on safety net cable 22 safety nets 20A and 20B are held up.

FIG. 6

Figure 6:
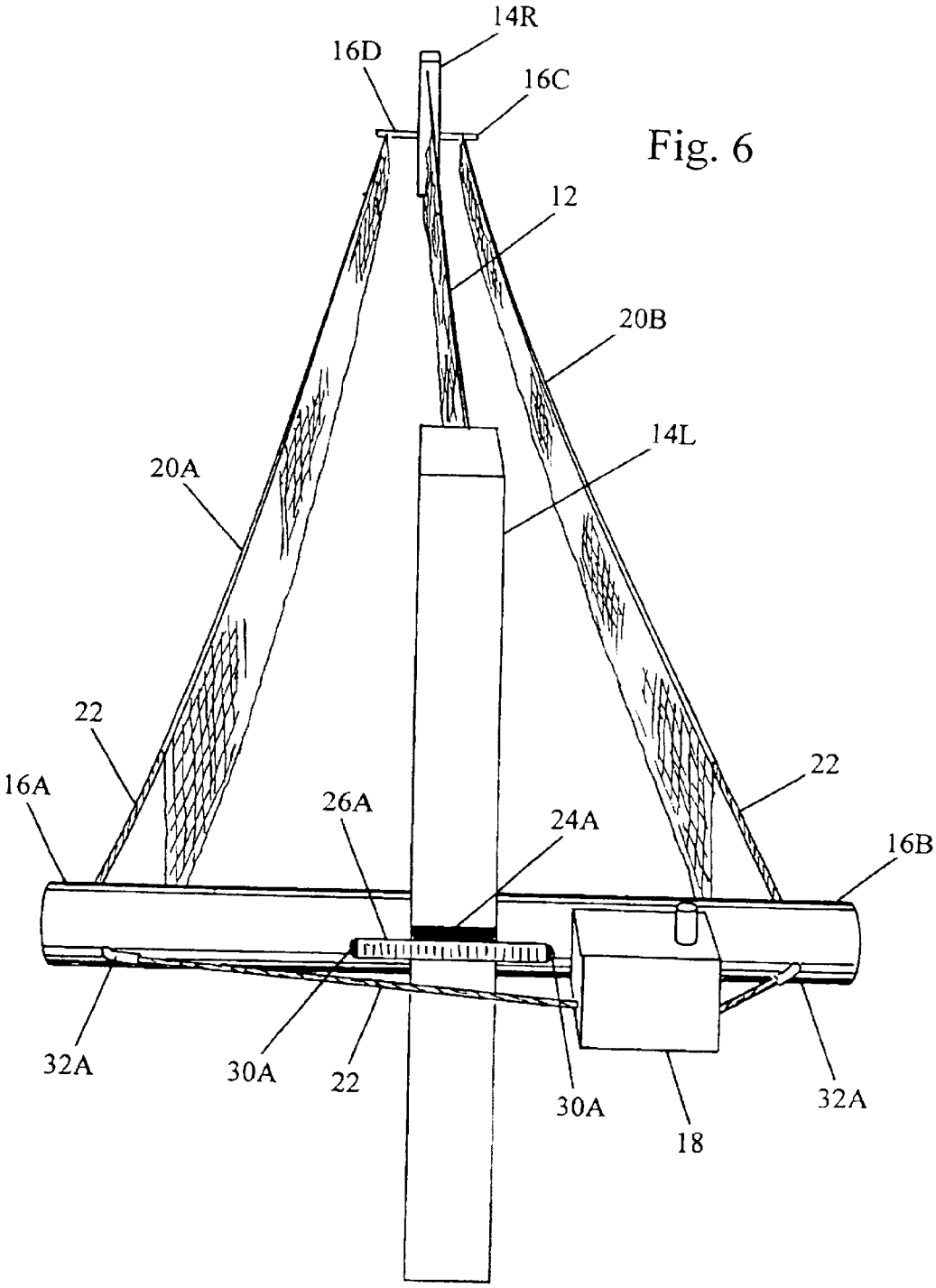
FIG. 6 is a perspective view from the left net post toward the right net post.

As shown if FIG. 6, a perspective view from the left tennis net post 14L to the right tennis net post 14R. Safety net cable 22 travels through safety net cable holes 32A and through horizontal posts 16A, 16B, 16C and 16D encircling tennis net posts 14L and 14R and tennis net 12. Tensioning device 18 tightens safety net cable 22 holding up safety nets 20A and 20B. Metal strap 26A travels through metal strap holes 30A connecting horizontal posts 16A and 16B. Starting fastener 24A is barely visible behind metal strap 26A.

OPERATION—FIGS 1–6

Before operation, the safety nets system must be properly installed on the tennis net posts 14L and 14R. The set-up of the safety nets system begins by having safety nets 20A and 20B on opposite sides of the tennis net 12. Horizontal posts 16A and 16B are connected together by metal strap 26A. Horizontal posts 16C and 16D are connected by metal strap 26B. Horizontal posts 16A and 16B are fit snugly on the sides of tennis net post 14L and horizontal posts 16C and 16D are fit snugly on the sides of tennis net post 14R. Starting fastener 24A, which travels through starting fastener holes 28A, is wrapped around tennis net post 14L about 18 inches above the court surface and manually tightened. Starting fastener 24B, which travels through starting fastener holes 28B, is wrapped around tennis net post 14R about 18 inches above the court surface and manually tightened. Once both net posts 14L and 14R have the horizontal posts 16A, 16B, 16C and 16D secured by starting straps 24A and 24B the safety nets system is now ready to be tightened by tensioning device 18. As tensioning device 18 tightens safety net cable 22 which travels through the safety net cable holes 32A and 32B, horizontal posts 16A and 16B are squeezed against tennis net post 14L and horizontal posts 16C and 16D are squeezed against tennis net post 14R. Once the safety net cable 22 has enough tension applied to it, the safety nets system will hold up the safety nets 20A and 20B. Tennis balls that are now hit into the tennis net 12 will roll down and get caught by the safety nets 20A and 20B before they can roll into the playing area.

Once the players or coaches are finished using the safety nets system it can be removed from the tennis net posts 14L and 14R in minutes by reversing the set-up procedure. If the players or coaches decide to leave the safety net system up, all that they would have to do is lessen the tension on safety net cable 22. When they want to use the safety nets system again it would only take seconds to tighten safety net cable 22 for the safety nets system to be ready for full use.

I claim:

1. A tensioned tennis net system consisting of:

(a) a pair of adjustable, non-stretchable straps, each strap adapted to contact the outer surface of a tennis net post;

(b) two pairs of horizontal posts, said horizontal posts being substantially the same length, wherein each said pair of posts is joined together by one of said straps;

(c) a pair of adjustable, non-stretchable fasteners, each fastener attached to a pair of horizontal posts for fastening the ends of said straps together;

(d) a cable passing through said horizontal posts and capable of encircling a tennis net and net posts;

(e) a tensioning device for tightening said cable to create static friction between said horizontal posts and net posts for maintaining said horizontal posts in place; and, (f) a pair of nets attached to said cable, said nets being as long as, but at a height lower than, a conventional tennis net and adapted to be positioned a distance from, and approximately parallel to, a tennis net.

* * * * *